US005591088A

United States Patent [19]

Bianco et al.

[11] Patent Number: 5,591,088

[45] Date of Patent: Jan. 7, 1997

[54] ELECTRONIC GOLFING AID

[76] Inventors: John L. Bianco, 7232 Laura Lee La., Seven Hills, Ohio 44131; Michael J. Ference, 9324 Oxford Trail, Brecksville, Ohio 44141

[21] Appl. No.: 520,830

[22] Filed: Aug. 29, 1995

[51] Int. Cl.[6] ..... A63B 69/36; A63B 57/00; G06F 15/00

[52] U.S. Cl. ..... 473/131; 473/266; 463/1; 364/410; 395/50; 434/252

[58] Field of Search ..... 273/85 G, 32 H; 434/252, 118; 395/10, 50, 62; 364/411, 410; 463/1, 43; 473/131, 266

[56] References Cited

U.S. PATENT DOCUMENTS

| | | | |
|---|---|---|---|
| 3,122,846 | 1/1963 | Trent | 434/252 |
| 3,671,724 | 6/1972 | Sanders | 364/410 |
| 4,220,992 | 9/1980 | Blood et al. | 364/410 |
| 4,490,811 | 12/1984 | Yianilos et al. | 364/567 |
| 4,815,020 | 3/1989 | Cormier | 273/32 H |
| 4,830,618 | 5/1989 | David | 434/169 |
| 4,864,854 | 9/1989 | vanLeemput | 473/407 |
| 4,964,063 | 10/1990 | Esch | 395/62 |
| 4,977,503 | 12/1990 | Rudnick et al. | 273/461 |
| 5,113,340 | 5/1992 | McWherter | 364/419.12 |
| 5,117,358 | 5/1992 | Winkler | 364/410 |
| 5,214,679 | 5/1993 | Metcalf | 473/407 |
| 5,218,536 | 6/1993 | McWherter | 364/419.12 |
| 5,294,110 | 3/1994 | Jenkins et al. | 473/407 |
| 5,427,370 | 7/1994 | Hamblin et al. | 273/32 H |

FOREIGN PATENT DOCUMENTS

| | | | |
|---|---|---|---|
| 2144644 | 3/1985 | United Kingdom | 273/85 G |

*Primary Examiner*—Jessica Harrison
*Assistant Examiner*—James Schaaf
*Attorney, Agent, or Firm*—Pearne, Gordon, McCoy & Granger

[57] ABSTRACT

Proper golf swing characteristics for a particular shot are provided from an electronic device by successive overlaying of solution overlays associated with a hierarchy of decision parameters describing the shot.

3 Claims, 6 Drawing Sheets

| ORDER OF OPERATION | ATTRIBUTES: BALL POSITION | HAND POSITION | CLUB FACE | SWING TYPE | ITEM SELECTION |
|---|---|---|---|---|---|
| A | NULL | NULL | NULL | NULL | |
| B | MIDDLE | MIDDLE | NORMAL | NO CHANGE | FAIRWAY |
| C | MIDDLE | MIDDLE | NORMAL | NULL | |
| D | NO CHANGE | BACKLOCK | NO CHANGE | NO CHANGE | WOOD |
| E | MIDDLE | BACKLOCK | NORMAL | NULL | |
| F | BACK | FORWARD | NULL | INSIDE | FADE |
| G | BACK | BACKLOCK | NULL | INSIDE | |
| H | FORWARD | NO CHANGE | NORMAL | NO CHANGE | LF TO RT |
| SOLUTION | FORWARD | BACKLOCK | NORMAL | INSIDE | |

| ORDER OF OPERATION | ATTRIBUTES | | | | ITEM SELECTION |
|---|---|---|---|---|---|
| | BALL POSITION | HAND POSITION | CLUB FACE | SWING TYPE | |
| A | NULL | NULL | NULL | NULL | |
| B | MIDDLE | MIDDLE | NORMAL | NO CHANGE | FAIRWAY |
| C | MIDDLE | MIDDLE | NORMAL | NULL | |
| D | NO CHANGE | BACKLOCK | NO CHANGE | NO CHANGE | WOOD |
| E | MIDDLE | BACKLOCK | NORMAL | NULL | |
| F | BACK | FORWARD | NULL | INSIDE | FADE |
| G | BACK | BACKLOCK | NULL | INSIDE | |
| H | FORWARD | NO CHANGE | NORMAL | NO CHANGE | LF TO RT |
| SOLUTION | FORWARD | BACKLOCK | NORMAL | INSIDE | |

Fig.8

ELECTRONIC GOLFING AID

BACKGROUND OF THE INVENTION

The present invention relates to a method of operation of an electronic device for providing instructions to a user in response to user inputs and, in particular, to an electronic golfing aid.

Choosing the proper swing characteristics is often difficult for all but the most expert golfers. To help golfers determine the correct stance, ball position, hand position, club face angle, swing path, weight distribution, back swing length, and forward swing length, many instructional books, magazines and videos have been created.

For the most part, these aids are inconvenient or impractical for the golfer to use during actual play or even practice.

SUMMARY OF THE INVENTION

The present invention provides a small, economical, easy-to-use, pocket-sized device for providing a golfer with the proper swing characteristics for a particular shot.

The device incorporates a method for generating solutions sets. The method includes: providing a hierarchy of levels of decision parameters; providing a corresponding solution overlay for each parameter; choosing a desired parameter at each level; successively overlaying each solution overlay corresponding to each desired parameter; and providing a solution set corresponding to the overlayed solution overlays.

In particular, the device incorporates a method for generating golf swing instructions. The method includes: providing a hierarchy of levels of shot parameters; providing a corresponding swing overlay for each parameter; choosing a desired parameter at each level; successively overlaying each swing overlay corresponding to each desired parameter; and providing a swing solution corresponding to the overlayed swing overlays.

The method of the invention minimizes operator input resulting in both convenience and savings from minimal input controls on the device. Because the results are achieved by overlaying solution sets rather than calculating solutions, minimal hardware is required with very shallow memory traversals.

BRIEF DESCRIPTION OF THE DRAWINGS

FIG. 8 is a diagram showing the solution overlays and their overlaying results for the path of FIG. 7.

DESCRIPTION OF THE PREFERRED EMBODIMENTS

Figure 1:
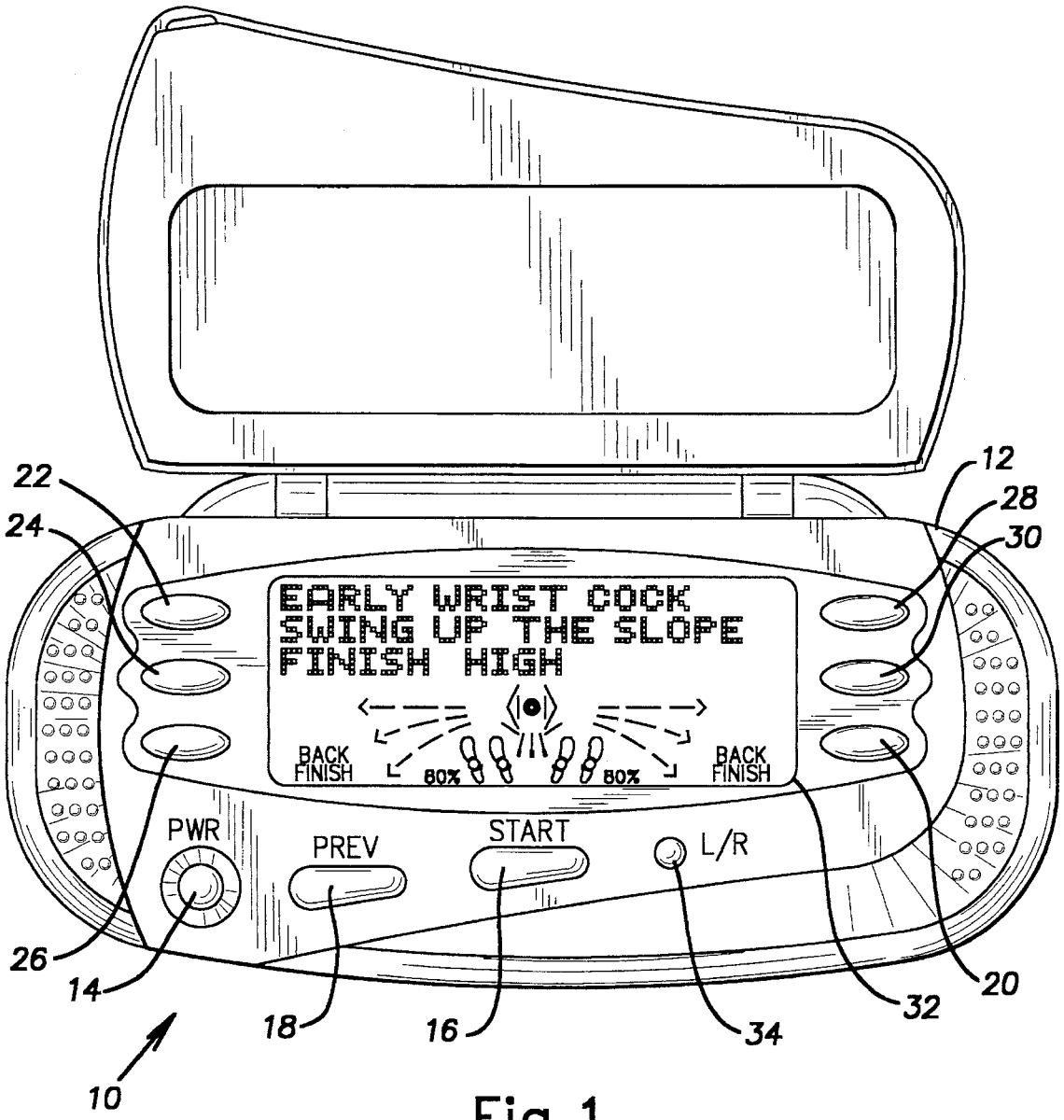
FIG. 1 is a top plan view of a golfing aid according to the invention showing possible graphical indicia and exemplary text of a swing solution.
Figures 2, 3, 4:
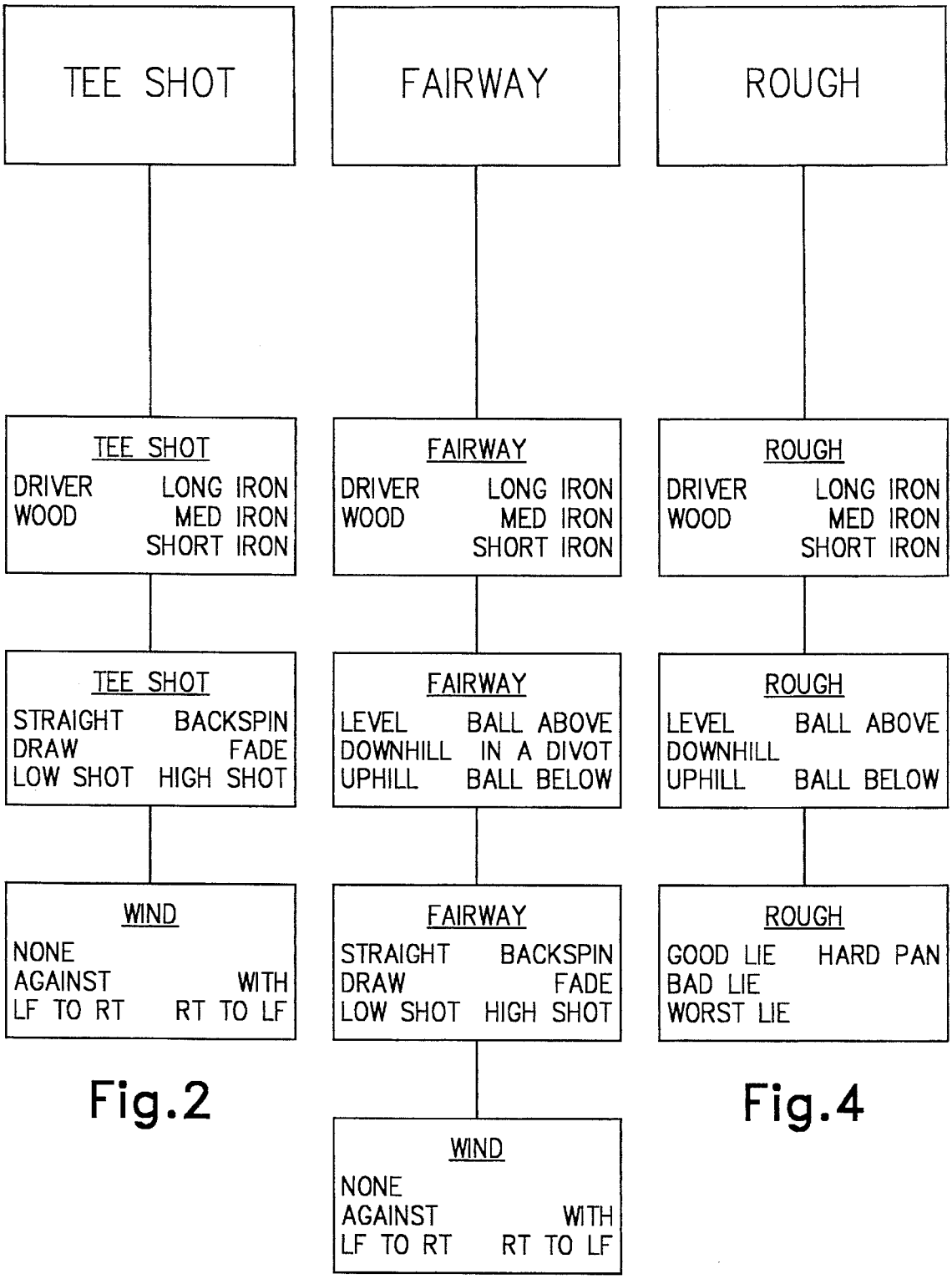
FIGS. 2–6 are diagrams of hierarchies of levels of decision parameters for a golfing aid according to the invention.
Figure 5:
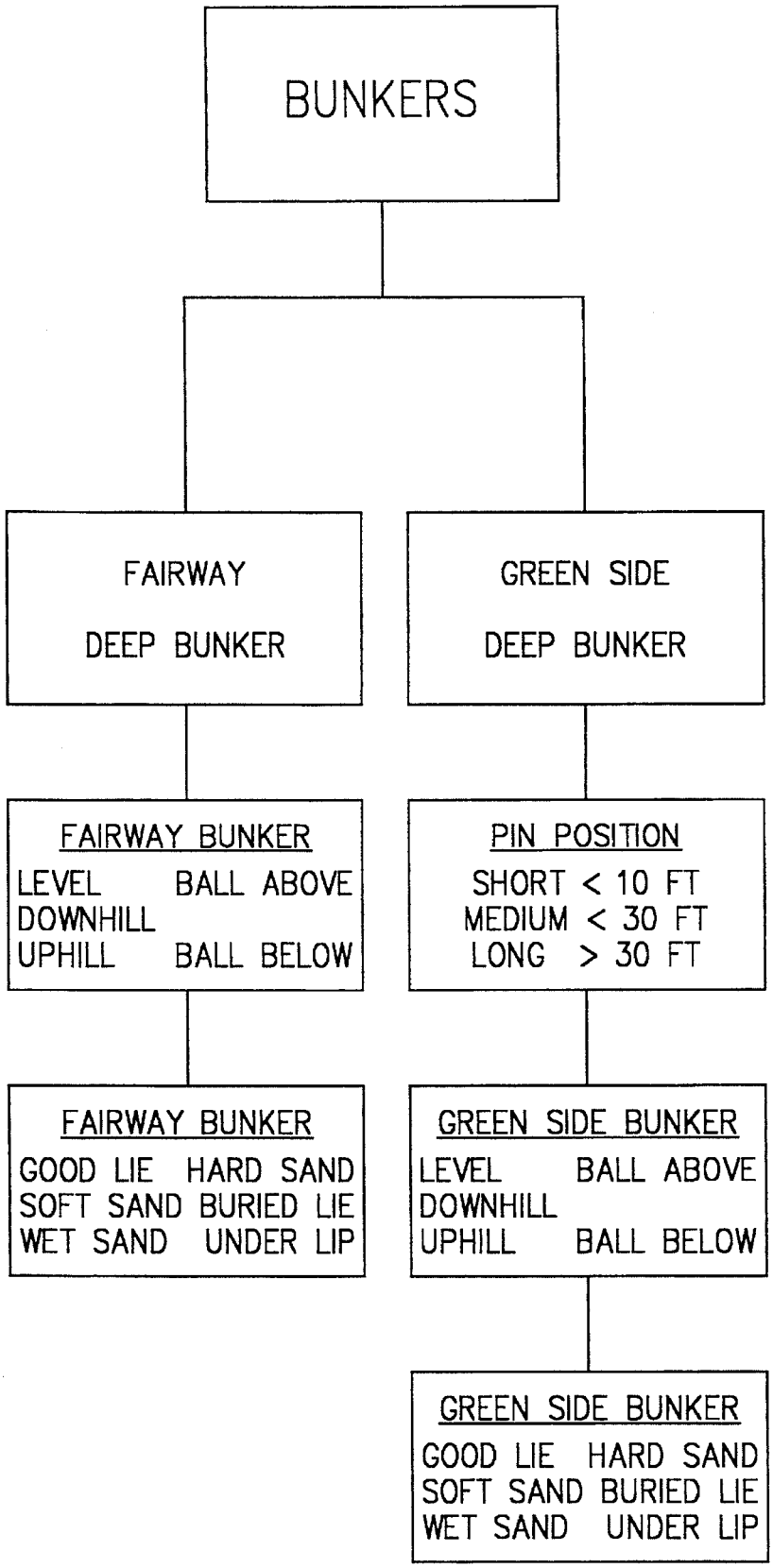
Figure 6:
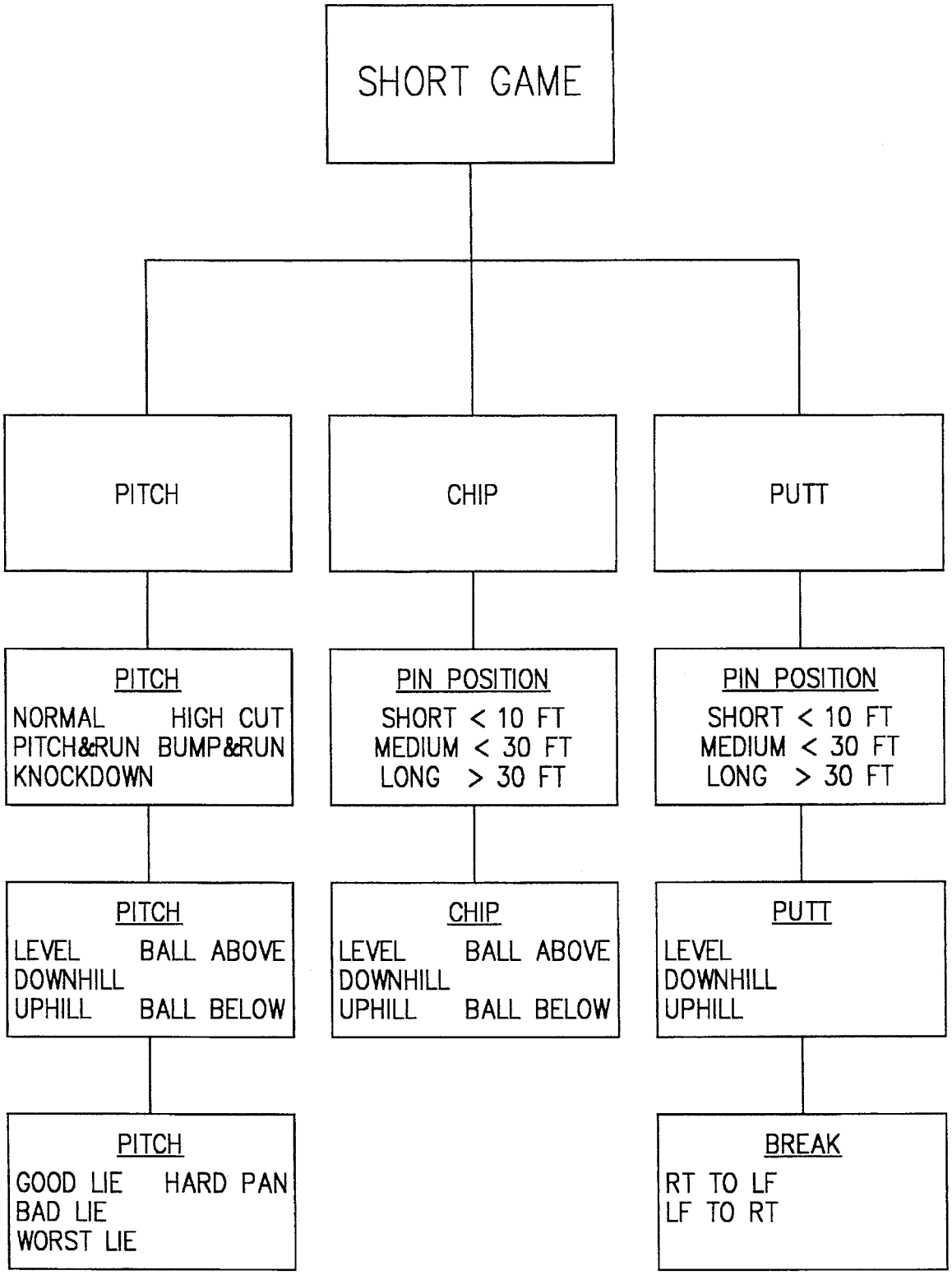

Referring to FIG. 1, an electronic golfing aid device 10 is contained in a pocket-sized, compact-like case 12. A power switch 14 controls the application of power from an internal battery to internal microprocessor-based electronics. The microprocessor-based electronics controls all functions in response to user inputs. A start switch 16 resets the device to the top of a series of hierarchial levels of menus described more fully below. A previous switch 18 allows moving backward towards the top of the menus one level at a time. The device 10 includes parameter selection switches 20, 22, 24, 26, 28, 30 for choosing a desired parameter at each successive level. A right/left switch 32 is provided to configure the device 10 for a left or right handed golfer.

A display 34 (e.g., an LCD) is provided to display decision parameters and the solution set after the operator inputs have been provided. In one embodiment of the invention, the solution set corresponds to a swing solution that provides the necessary guidance to a golfer to properly make a shot. The display 34 may include, for example, graphical indicia (e.g., foot position, swing path, hand position, and club face angle) and textual indica (e.g., decision parameters, percentage of back and forward swing and other alphanumerical instructions).

Referring to FIGS. 2–6, a series of hierarchial levels of decision parameters suitable for use in a golfing aid are illustrated. Initially, the text at the top of the figures is displayed on the display 32 adjacent to respective switches 22, 24, 26, 28, 30. An operator pushing one of the switches 22, 24, 26, 28, 30 is then provided with the decision parameters of the next lower level for the series of hierarchial levels of decision parameters corresponding to the chosen switch. In the case of a golfing aid, these decision parameters correspond to shot parameters. These parameters are displayed on the display 32 adjacent to spatially corresponding switches 20, 22, 24, 26, 28, 30.

Each time the operator chooses a parameter by pushing a spatially corresponding switch, another level of decision parameters is displayed until all levels are navigated. The device 10 then provides a solution set on the display 32. In the case of a golf aid, the display 32 provides a swing solution for instructing the golfer how to make the desired shot.

The device 10 utilizes a solution overlaying technique to generate the solution set. Each parameter in the hierarchial levels of decision parameters has a corresponding solution overlay. These solution overlays include a series of items that correspond to a series of items in the solution set.

As a parameter is chosen at each successive level, the corresponding solution overlay is used to overlay the previous solution overlay. The result of the overlaying of all of the successive overlays is the solution set.

Items in a solution overlay can be, for example, of four types: a dominant item, a locked item, a no-change item, or a null item.

When overlayed with a previous solution overlay, a dominate item will replace any other corresponding item except a locked item. A locked item replaces any previous corresponding nonlocked item and, once selected, survives to the solution set. A no-change item leaves the previous corresponding item unchanged. A null item replace any previous corresponding nonlocked item with a null entry. A null entry item in the solution set effectively removes that item from the solution set.

Figure 7:
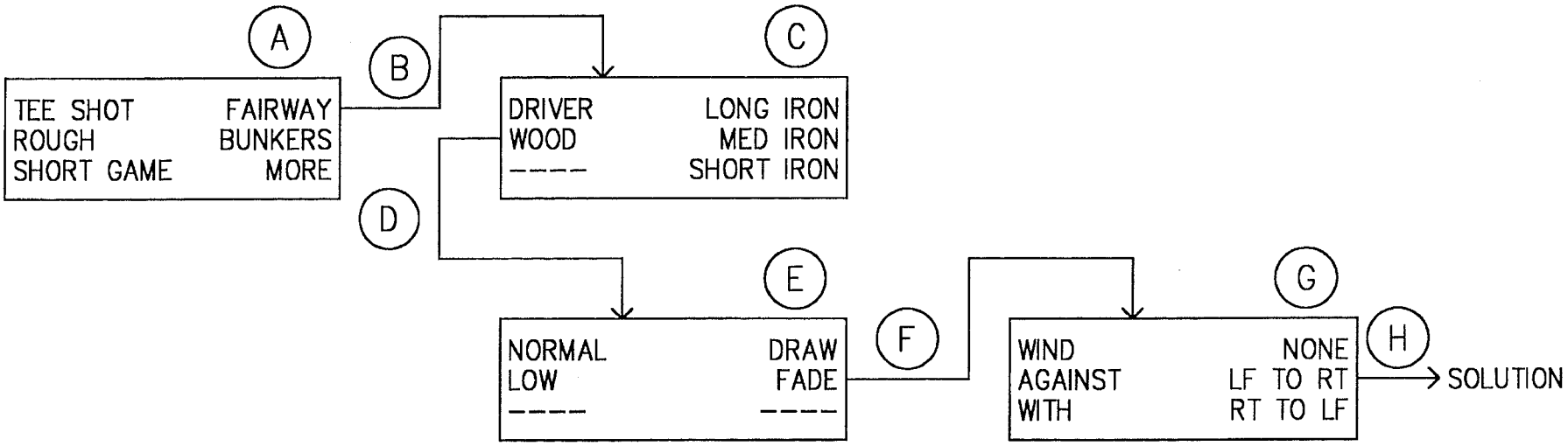
FIG. 7 is an exemplary path through an abbreviated hierarchy of decision parameters.

Referring to FIGS. 7 and 8, an example of generating a solution set or swing solution in a golfing aid is shown. The solution overlays and results are identified by reference letters in FIG. 8. The corresponding points in the path through the hierarchy of decision parameters are identified with the same reference letters.

The initial solution (or swing) overlay A is all null entries. When the operator chooses the decision parameter "FAIRWAY" the corresponding overlay B is overlayed with the overlay A. Each of the items in the overlay B are dominate items so they replace the items in the overlay A. This results in the overlay C.

When the operator chooses the parameter "WOOD" the corresponding overlay D is overlayed with the overlay C. The overlay D has three no-change items and a locked item. The resulting overlay E contains the three items from the overlay C that were overlayed by the corresponding no-change items of overlay D plus the locked item which replaced the corresponding item of overlay C.

When the operator chooses the parameter "FADE" the corresponding overlay F is overlayed with the overlay E. The overlay F has three dominant items and a null item. In the resulting overlay G, the overlay F items replace each item in the overlay E, except that "Hand Position" is locked at back ("BACK LOCK").

When the operator chooses the parameter left-to-right ("LF_TO_RT") in the last level of the hierarchy, a solution set (or swing solution) is produced. When left-to-right is chosen, the corresponding overlay H is overlayed with the overlay G. The overlay H has two dominant items and two no-change items. In the resulting solution set, the dominant items replace the corresponding previous items and the no-change items allow the items from overlay G to remain unchanged.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. A method for generating solutions sets in an electronic device, said method comprising:

providing a hierarchy of levels of decision parameters;

providing a corresponding solution overlay for each parameter;

choosing a desired parameter at each level;

successively overlaying each solution overlay corresponding to each desired parameter; and providing a solution set corresponding to said overlayed solution overlays, said solution set including a series of items and said solution overlays each including a series of items that correspond to the series of items in the solution set, wherein said solution overlays include at least one of: dominant items that will replace previous items; no-change items that will not replace previous items; locked items that are locked from further change; or null items that null previous items.

2. A method for generating golf swing instructions in an electronic device, said method comprising:

providing a hierarchy of levels of shot parameters;

providing a corresponding swing overlay for each parameter;

choosing a desired parameter at each level;

successively overlaying each swing overlay corresponding to each desired parameter; and providing a swing solution corresponding to said overlayed swing overlays, said swing solution including a series of items and said swing overlays each including a series of items that correspond to the series of items in the swing solution.

3. A method according to claim 2, wherein said swing overlays include at least one of: dominant items that will replace previous items; no-change items that will not replace previous items; locked items that are locked from further change; or null items that null previous items.

* * * * *